US012551775B2

(12) United States Patent
Yeh

(10) Patent No.: US 12,551,775 B2
(45) Date of Patent: Feb. 17, 2026

(54) SPRING LOCK FOR SKATE WHEEL

(71) Applicant: Ching-Ho Yeh, Guangdong (CN)

(72) Inventor: Ching-Ho Yeh, Guangdong (CN)

( * ) Notice: Subject to any disclaimer, the term of this patent is extended or adjusted under 35 U.S.C. 154(b) by 69 days.

(21) Appl. No.: 18/825,594

(22) Filed: Sep. 5, 2024

(65) Prior Publication Data

US 2025/0010169 A1 Jan. 9, 2025

(51) Int. Cl.
*A63C 17/20* (2006.01)
*A63C 17/22* (2006.01)

(52) U.S. Cl.
CPC ..... *A63C 17/20* (2013.01); *A63C 17/22* (2013.01)

(58) Field of Classification Search
CPC ..... A63C 17/20; A63C 17/22
USPC ..... 70/57
See application file for complete search history.

(56) References Cited

U.S. PATENT DOCUMENTS 6,364,322 B1 * 4/2002 Lee ..... A63C 17/20 280/11.27
6,913,270 B2 * 7/2005 Wang ..... A63C 17/20 280/11.27
6,926,289 B2 * 8/2005 Wang ..... A63C 17/20 280/11.24
7,607,519 B1 * 10/2009 Keegan ..... B60T 1/14 254/8 B
7,914,011 B1 * 3/2011 Bromer ..... A63C 17/1436 188/29
2008/0012249 A1 * 1/2008 von Detten ..... A63C 17/062 280/11.27
2010/0148459 A1 * 6/2010 Johnston ..... A63C 17/02 280/11.18
2011/0193303 A1 * 8/2011 Green ..... A63C 17/04 280/11.26
2022/0266120 A1 * 8/2022 Cunningham ..... A63C 17/08
2023/0102779 A1 * 3/2023 Kermani ..... A63C 17/016 280/87.042
2024/0173614 A1 * 5/2024 Zimmer ..... A63C 17/20
2024/0181328 A1 * 6/2024 Woods ..... A63C 17/0086
2024/0189699 A1 * 6/2024 White, III ..... A63C 17/02

* cited by examiner

*Primary Examiner* — Nathan Cumar
(74) *Attorney, Agent, or Firm* — LANWAY IPR SERVICES; Chun-Ming Shih

(57) ABSTRACT

A spring lock for a skate wheel includes a housing including opposite first and second holes, and a third hole; a pin through the first and second holes and including first and second grooves; a button on the third hole; a back plate on a back of the housing; a first biasing member secured to the back plate; a stop member secured to the first groove; a sliding member having one end urging against the first biasing member and the other end contacting the button to slidably dispose on the second groove, the sliding member including small and large holes; and a second biasing member on the pin and having one end urging against an inner surface of the housing and the other end urging against the stop member. In a locked state, the pin extends into an elongated hole of between two spokes of the wheel.

1 Claim, 3 Drawing Sheets

SPRING LOCK FOR SKATE WHEEL

FIELD OF THE INVENTION

The invention relates to skates and more particularly to a spring lock having a pin capable of extending into an elongated hole between two spokes of a wheel of a skate.

BACKGROUND OF THE INVENTION

Conventionally, a wheel of a roller skate does not have a lock. Thus, it is impossible to lock the wheel if such need arises.

Thus, the need for improvement still exists.

SUMMARY OF THE INVENTION

It is therefore one object of the invention to provide a spring lock for a wheel of a skate, the wheel including a plurality of spokes and a plurality of elongated holes each disposed between two adjacent ones of the spokes, comprising a housing threadedly secured to a bottom of the skate besides the wheel, the housing including a first hole, a second hole opposing the first hole, and a third hole; a pin passing through the first hole and the second hole, the pin including a head disposed externally of the first hole, a first circular groove, and a second circular groove; a button disposed on the third hole; a back plate disposed on a back of the housing; a first biasing member secured to the back plate; a stop member secured to the first circular groove; a sliding member having a first end urging against the first biasing member and a second end contacting the button so that the sliding member is configured to slidably dispose on the second circular groove, the sliding member including a first hole member and a second hole member communicating with the first hole member and being larger than the first hole member; and a second biasing member disposed on the pin, the second biasing member having a first end urging against an inner surface of the housing proximate the second hole and a second end urging against the stop member; wherein in a locked state of the wheel, an end of the pin extends into the elongated hole, the first hole member fastens the second biasing member at a position of facing the second circular groove.

The above and other objects, features and advantages of the invention will become apparent from the following detailed description taken with the accompanying drawings.

DETAILED DESCRIPTION OF THE INVENTION

Figure 1:
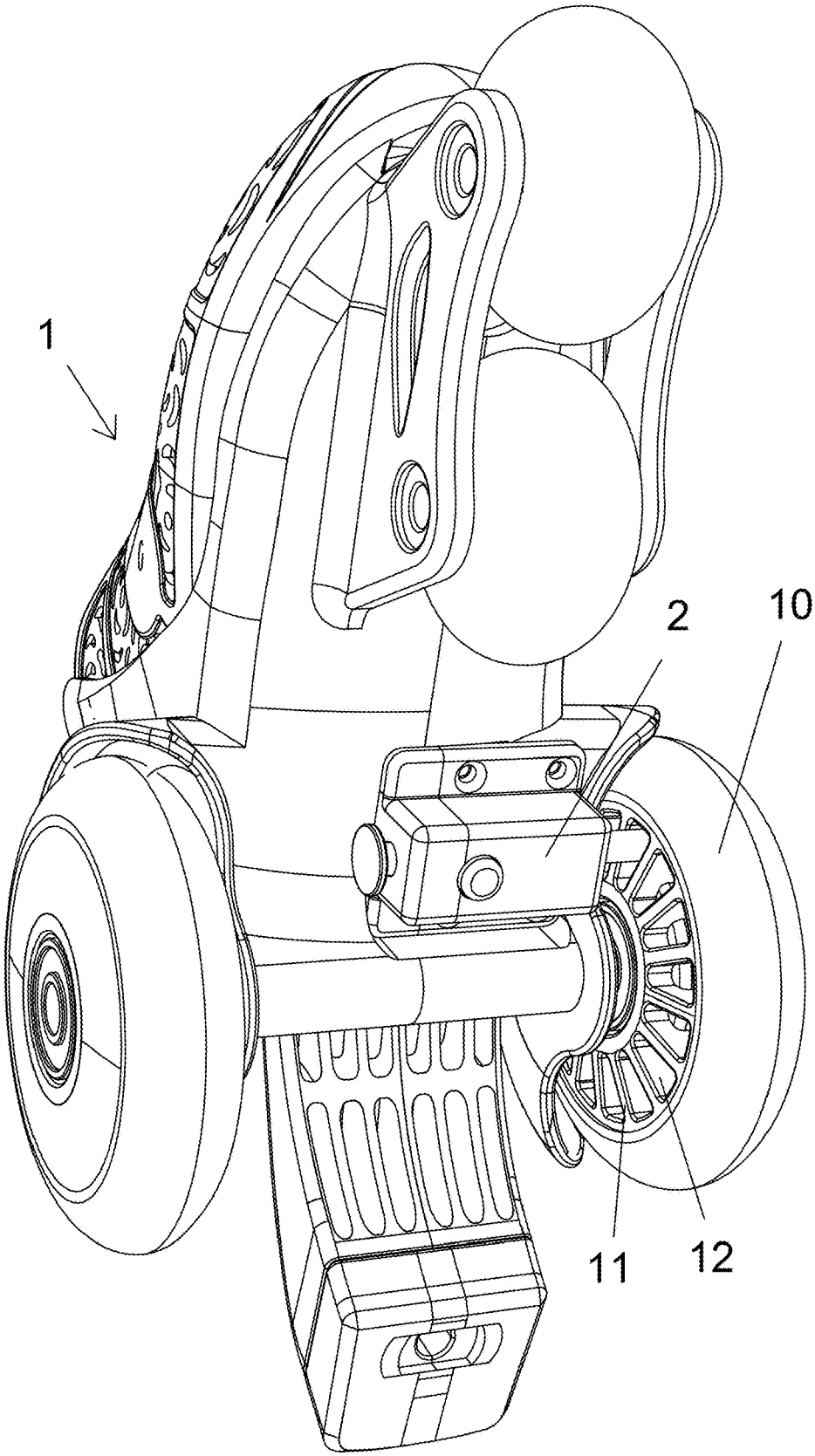
FIG. 1 is a perspective view of a roller skate incorporating a spring lock according to the invention, the spring lock being disposed on a bottom of the roller skate besides a rear wheel.
Figure 2:
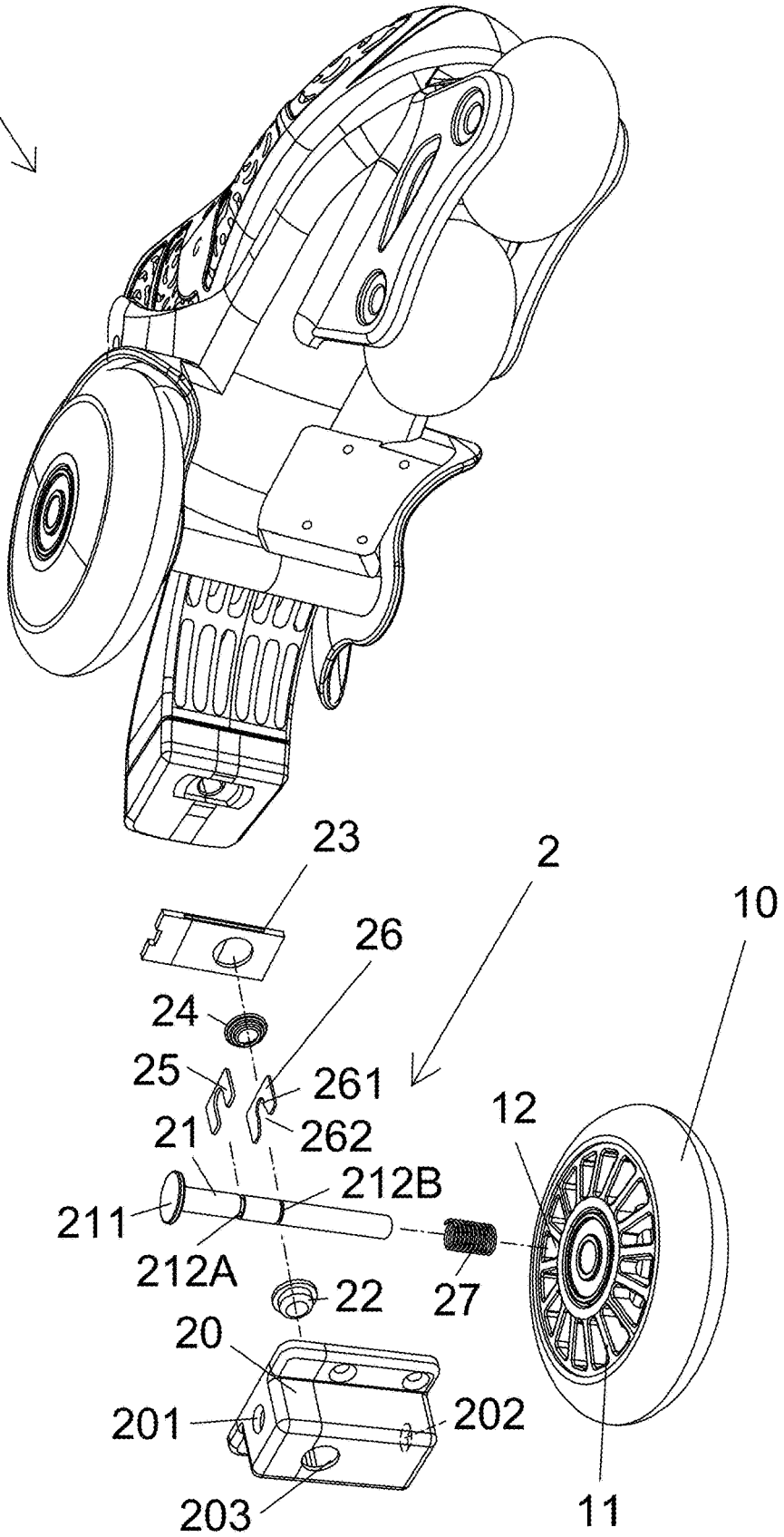
FIG. 2 is an exploded view of the spring lock.

Referring to FIGS. 1 to 4, a roller skate 1 incorporating a spring lock 2 in accordance with the invention is shown. The roller skate 1 comprises a plurality of wheels 10 including a plurality of spokes 11 and a plurality of elongated holes 12 each disposed between two adjacent ones of the spokes 11.

The spring lock 2 comprises a housing 20 threadedly secured to a bottom of the roller skate 1 besides the rear wheel 10, the housing 20 including a first hole 201, a second hole 202 opposing the first hole 201, and a third hole 203; a pin 21 passing through the first hole 201 and the second hole 202, the pin 21 including a head 211 disposed externally of the first hole 201, a first circular groove 212A, and a second circular groove 212B; a button 22 disposed on the third hole 203; a back plate 23 disposed on a back of the housing 20; a first spring (e.g., compression spring) 24 secured to the back plate 23; a stop member 25 secured to the first circular groove 212A; a sliding member 26 having one end urging against the first spring 24 and the other end contacting the button 22 so as to slidably dispose on the second circular groove 212B, the sliding member 26 including a small hole 261 and a large hole 262 communicating with the small hole 261; and a second spring (e.g., compression spring) 27 disposed on the pin 21, the second spring 27 having one end urging against an inner surface of the housing 20 proximate the second hole 202 and the other end urging against the stop member 25.

In a locked state of the wheel 10, an end of the pin 20 extends into the elongated hole 12, the small hole 261 fastens the compressed second spring 27 at a position of facing the second circular groove 212B.

Figure 3:
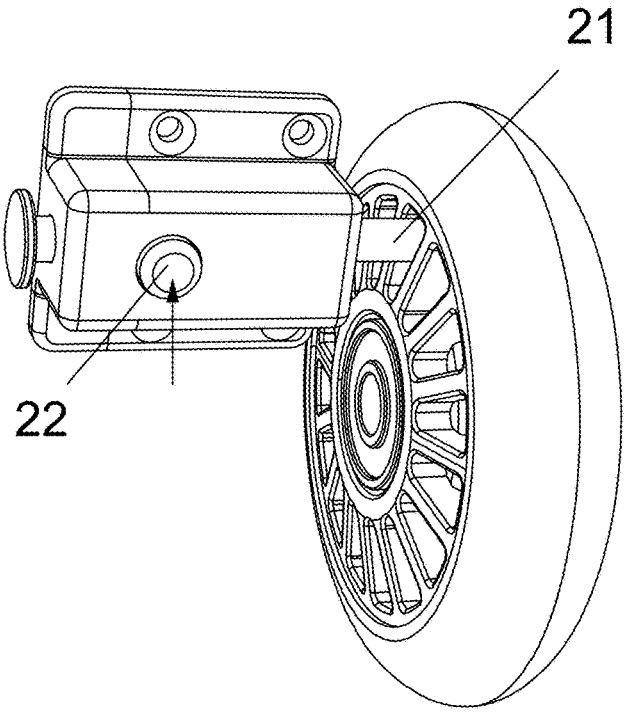
FIG. 3 a perspective view schematically depicting how to unlock the wheel by pressing a button of the spring lock.
Figure 4:
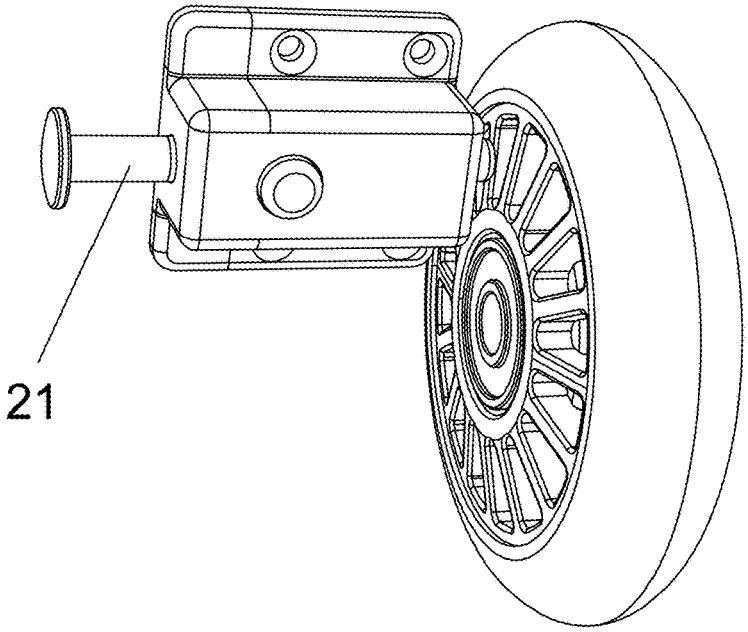
FIG. 4 is a perspective view schematically depicting the unlocked wheel.

For unlocking the wheel 10, a person may press the button 22 as indicated by arrow in FIG. 3. The sliding member 26 moves toward the back plate 23 to disengage the small hole 26 from the second spring 27. The sliding member 26 compresses the first spring 24 to align the large hole 262 with the second spring 27. The second spring 27 releases its compression energy to push the stop member 25 toward the first hole 201 until the stop member 25 is stopped by the inner surface of the housing 20 proximate the first hole 201.

For locking the wheel 10 again, the person may press the head 211 to push the stop member 25 toward the second hole 202 until being stopped. At this position, the large hole 262 is aligned with the second circular groove 212B and the end of the pin 20 extends into the elongated hole 12. Next, the first spring 24 releases its compression energy to push both the sliding member 26 and the button 22 toward the third hole 213. Next, the small hole 261 fastens the compressed second spring 27 at the position of facing the second circular groove 212B. As a result, the wheel 10 is locked.

While the invention has been described in terms of preferred embodiments, those skilled in the art will recognize that the invention can be practiced with modifications within the spirit and scope of the appended claims.

What is claimed is:

1. A spring lock for a wheel of a skate, the wheel including a plurality of spokes and a plurality of elongated holes each disposed between two adjacent ones of the spokes, comprising:

a housing threadedly secured to a bottom of the skate besides the wheel, the housing including a first hole, a second hole opposing the first hole, and a third hole;

a pin passing through the first hole and the second hole, the pin including a head disposed externally of the first hole, a first circular groove, and a second circular groove;

a button disposed on the third hole;

a back plate disposed on a back of the housing;

a first biasing member secured to the back plate;

a stop member secured to the first circular groove;

a sliding member having a first end urging against the first biasing member and a second end contacting the button so that the sliding member is configured to slidably dispose on the second circular groove, the sliding member including a first hole member and a second hole member communicating with the first hole member and being larger than the first hole member; and a second biasing member disposed on the pin, the second biasing member having a first end urging against an inner surface of the housing proximate the second hole and a second end urging against the stop member;

wherein in a locked state of the wheel, an end of the pin extends into the elongated hole, the first hole member fastens the second biasing member at a position of facing the second circular groove.

* * * * *